US006571909B1

(12) United States Patent
Olinger

(10) Patent No.: US 6,571,909 B1
(45) Date of Patent: Jun. 3, 2003

(54) LOUDSPEAKER ENCLOSURE

(76) Inventor: Jeffrey Olinger, 4425 George Mills Civic Pkwy., Unit 405, West Des Moines, IA (US) 50265

( * ) Notice: Subject to any disclaimer, the term of this patent is extended or adjusted under 35 U.S.C. 154(b) by 0 days.

(21) Appl. No.: 09/944,834

(22) Filed: Aug. 31, 2001

(51) Int. Cl.[7] ..... A47B 81/06
(52) U.S. Cl. ..... 181/199; 181/146; 181/151
(58) Field of Search ..... 181/144, 146, 181/151, 152, 154, 156, 166, 199

(56) References Cited

U.S. PATENT DOCUMENTS 4,142,604 A * 3/1979 Smith ..... 181/156
4,167,985 A * 9/1979 Dunlavy ..... 181/146
4,433,749 A * 2/1984 Watkins et al. ..... 181/151
4,811,403 A 3/1989 Henricksen
4,869,340 A 9/1989 Coudoux
5,123,500 A * 6/1992 Malhoit et al. ..... 181/152
5,682,436 A 10/1997 Sakamoto
5,731,555 A 3/1998 Anagnos
5,900,593 A 5/1999 Adamson

* cited by examiner

*Primary Examiner*—Khanh Dang
(74) *Attorney, Agent, or Firm*—James A. Napier

(57) ABSTRACT

Described is a loudspeaker enclosure arrangement that reduces, by a large degree, internal acoustic reflections, enclosure vibrations, and diffraction off the surfaces and edges of the loudspeaker enclosure. The loudspeaker exterior surfaces and edges are covered with acoustic damping foam. The enclosure is shaped to dissipate sound waves within the enclosure, rather than allowing the sound waves to reflect off its walls. To achieve the objects set forth above, the design comprises a loudspeaker in which the exterior of the side walls are prevented from communicating interfering sound by the placement of exterior sound-damping foam blocks. The design also comprises a loudspeaker enclosure that has a triangular horizontal cross section. Internal sound waves diminish toward the distal point of the enclosure and are not reflected forwardly.

2 Claims, 2 Drawing Sheets

LOUDSPEAKER ENCLOSURE

BACKGROUND OF THE INVENTION

1. Field of the Invention

This invention relates to the art of loudspeakers employed in the amplification of sound, particularly those used with high fidelity sound reproduction, and in the minimization of distortion and refraction of sound through the enclosure in which the loudspeakers are housed.

2. Description of the Prior Art

The reproduction of audio sound requires the use of electroacoustic transducers. The transducers transform the input signal into audible sound energy. The transducers are conventionally mounted within an enclosure. Conventional loudspeaker enclosures introduce interference into the atmosphere in which the speakers are housed. Among the types of interference introduced are reflection of sound within the speaker enclosure, enclosure vibration, and diffraction of sound at edges and anomalies of the speaker enclosure.

Some prior art loudspeakers have been designed with features that attempt to defeat some of these problems by different means. Some speaker manufacturers have devised internal baffle systems that prevent the direct "bounce-back" of the rear sound wave produced by the transducer. This problem has also been addressed by installing elongated cones within a speaker to diffuse and dissipate these sound waves. Other manufacturers have created intricate rigid structures within speaker enclosures to defeat cabinet vibration. Others have designed foam covered front baffles that dampen "bounce-back" sound waves.

These designs have failed to mitigate all the interference introduced by the loudspeaker enclosure and have required the introduction of irregular parts or expensive construction techniques.

SUMMARY OF THE INVENTION

Conventional loudspeakers that incorporate electroacoustic transducers fail to produce pure sound. This is so, at least in part, because the enclosures in which the loudspeakers are housed produce interference with the sound that the loudspeakers generate. Examples of this interference are internal reflections, enclosure vibrations, and diffraction.

Reflection of sound occurs when a sound wave bounces off a surface. In traditional loudspeakers, which have a horizontal cross-section shaped like a parallelogram, reflection commonly occurs from the sound produced by the acoustic transducer reflecting off the back wall of the enclosure toward the front baffle in which the transducers are mounted. This reflection produces uneven and conflicting sounds for the listener. Sound may also be reflected off the walls, floor, or ceiling of a room in which a loudspeaker is placed. This type of sound is commonly referred to as a "secondary wave".

Enclosure vibration, like all vibration, creates an interfering sound wave. Generally, an enclosure vibrates due to both the sound wave that is projected from the rear of the transducer and the vibration of the transducer at the point at which it is connected to the front baffle. The enclosure vibration creates an interfering sound wave that travels in essentially all directions, unlike the directed sound produced by the transducers.

Diffraction occurs when a sound wave encounters a discontinuity in the medium through which it is traveling. A sound wave produced by a transducer mounted on a flat surface will travel along the face of that surface until the surface ends. At this point, the sound wave bends to fill the space available to it. This bending alters the sound wave and corrupts the original sound wave. Diffraction also occurs when a sound wave travels through one medium and into a different medium. This type of interference is also commonly caused by traditional loudspeaker enclosures. Sound enters the medium from which the enclosures are built, typically from the interior of the enclosure, and travels through that medium to a point where it enters the surrounding atmosphere. Sound waves typically leave the medium of the enclosure at a point that presents a discontinuity, such as an edge or a corner of the enclosure. The sound produced by diffraction normally differs greatly from that produced by the loudspeaker in timing, pitch, and timbre.

Prior art speakers have employed several methods to defeat these forms of interference. One common method of damping this interference is the mounting of damping material, such as acoustic foam, on the interior of the enclosure walls. Although this technique has some effectiveness in defeating reflection within the enclosure, the foam in prior art speakers fails defeat interference caused by enclosure vibration or secondary waves. Furthermore, traditional loudspeaker enclosures have a back wall that is parallel or substantially parallel to the front baffle. The sound reflected off the back wall of the enclosure is dispersed not only through the front baffle, but also through the transducers themselves. Finally, traditional loudspeaker enclosures fail to defeat interference created by diffraction of sound at the edges of the enclosure.

It is an object of the present invention to provide a loudspeaker enclosure that significantly reduces internal acoustic reflections, enclosure vibrations, and diffraction of sound off the edges of the loudspeaker enclosure.

It is a further object of the present invention to minimize internal acoustic reflections and diffraction in a loudspeaker enclosure to provide an improved sound field and improved sound reproduction.

It is an additional object of this invention to provide a loudspeaker enclosure that is comprised of materials that are widely available and inexpensive to obtain.

Additional objects of the invention will be set forth in the description that follows, and will become apparent to those skilled in the art upon examination of the following.

The present invention provides a loudspeaker enclosure arrangement that reduces, by a large degree, internal acoustic reflections, enclosure vibrations, and diffraction off the surfaces and edges of the loudspeaker enclosure. The loudspeaker exterior surfaces and edges are covered with acoustic damping foam. The enclosure is shaped to dissipate sound waves within the enclosure, rather than allowing the sound waves to reflect off its walls. To achieve the objects set forth above, the present invention comprises a loudspeaker in which the exterior of the side walls are prevented from communicating interfering sound by the placement of exterior sound-damping foam blocks. The present invention also comprises a loudspeaker enclosure that has a triangular horizontal cross section. Internal sound waves diminish toward the distal point of the enclosure and are not reflected forwardly.

BRIEF DESCRIPTION OF THE DRAWINGS

The features advantages of the present invention will become more clearly appreciated as a description of the invention is made with reference to the appended drawings. In the drawings.

DETAILED DESCRIPTION OF THE INVENTION

Figure 1:
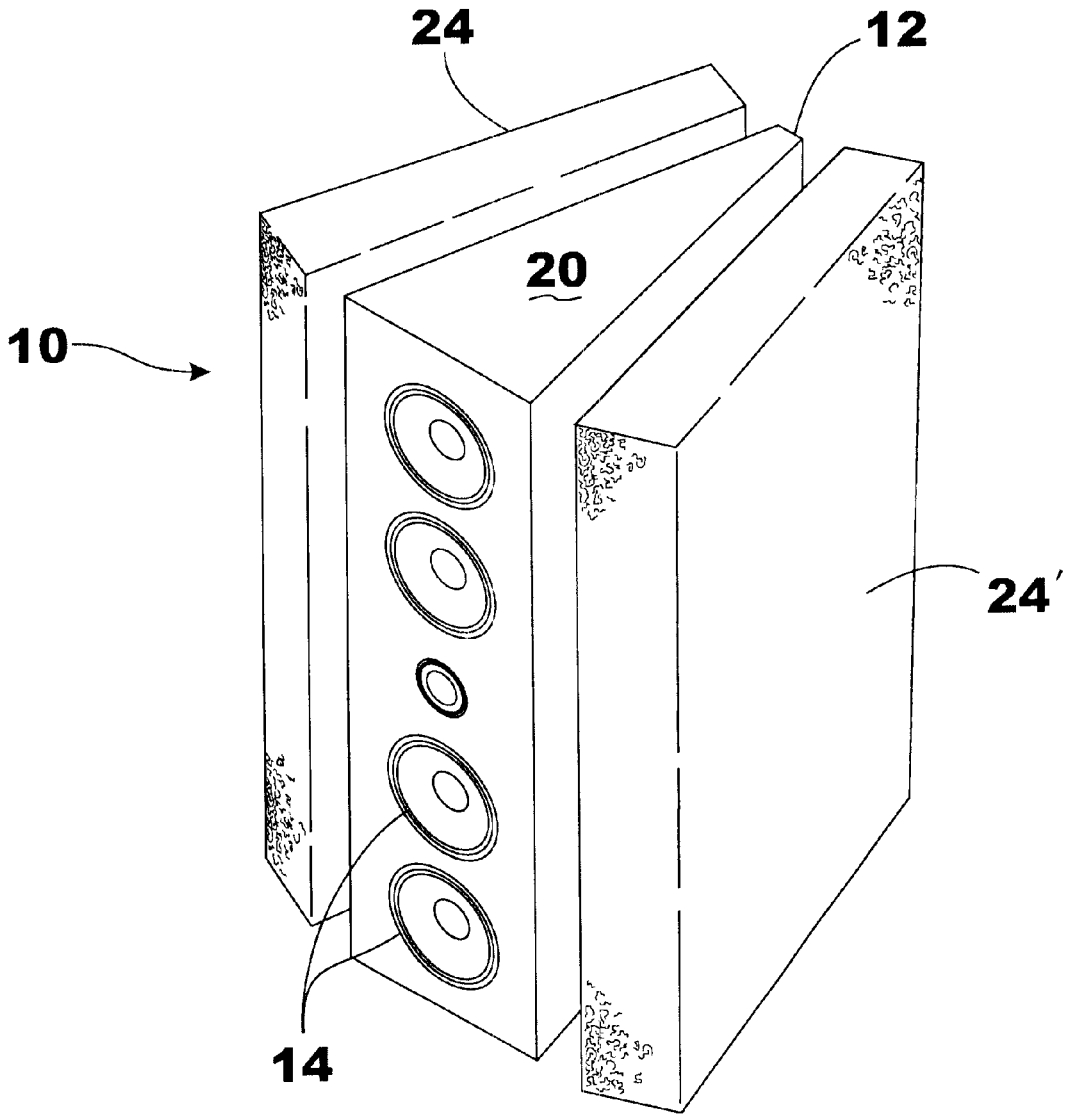
FIG. 1 is a perspective view of the loudspeaker enclosure of the present invention.

Preferred embodiments of the present invention will be described below by making reference to FIGS. 1, 2 and 3 of the drawings.

The present invention was developed for use in a high performance audio system. The loudspeaker 10, shown in FIG. 1, includes at least one electroacoustic transducer 14 (e.g., tweeter, midrange, woofer, and subwoofer). The electroacoustic transducers 14 are mounted to a front baffle 16 of the loudspeaker cabinet 12. The loudspeaker cabinet 12 has side walls 18 and 18', a top wall 20, a bottom wall 22, and an optional rear wall 24 which, together with the front baffle 16, form the loudspeaker cabinet 12. The height of the cabinet 12 will vary depending on the number of transducers 14 employed within the loud speaker 10. The loudspeaker cabinet 12 may be sealed or vented through a tuned pipe 30 in the traditional manner, depending on the electroacoustic transducers 14 used. Various other wires and electrical components (not shown) are mounted within the loudspeaker cabinet 12.

The loudspeaker cabinet 12 is constructed of rigid Material and may be comprised of medium density fiberboard, such as is standard in the industry. The exteriors of the side walls 18 and 18' are covered with acoustic damping foam blocks 24 and 24'. The characteristics of the foam used to cover the exterior surfaces of the loudspeaker cabinet 12 are important. Ideally, the foam blocks 24 and 24' will be made of polyurethane material and will have a density of two to three pounds per cubic foot and will be three to four inches thick. The positioning of the foam blocks 24 and 24' is also important. The foam blocks 24 and 24' must extend forwardly beyond the front edges 28 of the cabinet 12. The foam that extends beyond these points will arrest any diffraction of sound that would project from the edges of the cabinet 12. To achieve this end without interfering with the proper sound that is generated by the transducers 14, the foam blocks 24 and 24' should extend approximately one to two inches beyond the edges 28 of the cabinet 12. The foam blocks 24 and 24' , being positioned against the side walls 18 and 18' , will defeat any sound energy that emanates from those walls.

Figure 3:
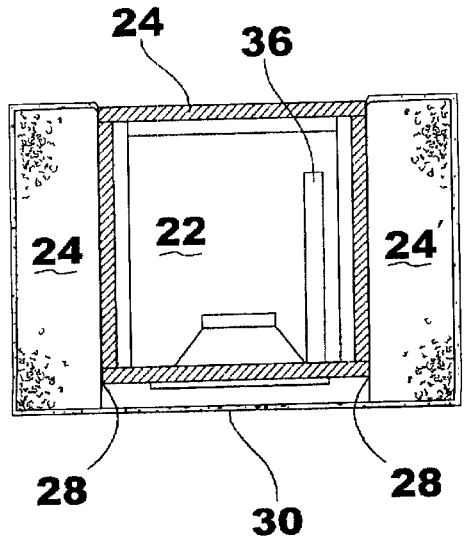
FIG. 3 is a horizontal cross section view of the loudspeaker enclosure having a rectangular shape according to the present invention.

By extending beyond the edges 28 of the cabinet 12, the foam blocks 24 and 24' may also be adapted to support a fabric grill 36 to protect the transducers 14 and enhance the appearance of the loudspeaker 10 as shown in FIG. 3. Fabric grills are common in the art, but are traditionally supported on the loudspeaker cabinet 12 by some sort of rigid frame. The mounting of the grill on a rigid frame provides points at which sound may be diffracted. The foam blocks 24 and 24' provide no medium through which a sound wave may travel, eliminating diffraction of sound through the grill 36. They also obviate the need for a rigid frame, as is conventionally used, removing an obstacle that can cause reflection and further distortion to the sound wave.

The foam blocks 24 and 24' also serve to dampen sound reflected off objects in the area of the loudspeaker 10. The reflected sound, known as a secondary wave, does nor reflect off the speaker enclosure 10, due to the damping effect of the foam blocks 24 and 24'.

Figure 2:
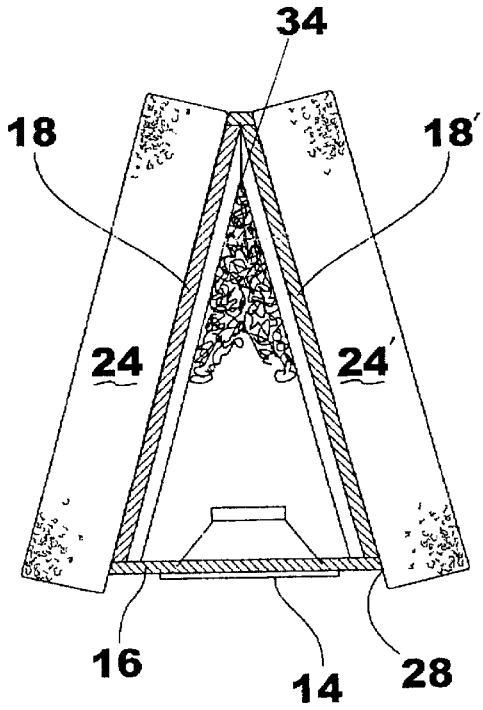
FIG. 2 is a horizontal cross section view of the loudspeaker enclosure having a triangular shape according to the present invention.

FIG. 2 shows details of the structure and interior of the loudspeaker enclosure 10. As can be seen from this figure, the cabinet 12 is constructed of materials that are commonly used in loudspeaker construction. Ideally, the cabinet 12 is shaped to dissipate sound waves within the enclosure, rather than allowing the interior sound waves to reflect off its walls. Although the exterior foam blocks 24 and 24' may be mounted on a speaker cabinet 12 having a traditional rectangular horizontal cross section, the loudspeaker cabinet 12 preferably has a triangular horizontal cross section. Sound waves that are produced by the transducers 14 at the front baffle 16 are primarily projected forwardly, away from the loud speaker 10. The transducers 14 also produce a rearward sound wave that is directed toward the interior of the cabinet 12. These rearward sound waves produce most of the distortion in amplified sound that has previously been described.

In the subject triangular loudspeaker enclosure, the front baffle 16 is narrower than the depth of the cabinet 12. The depth of the cabinet 12 is defined by the distance of a line that is perpendicular to the plane of the front baffle 16 and extends between the interior point where the side walls 18 and 18' meet and the front baffle 16. The depth of the cabinet 12 is ideally configured to have a depth to front baffle width ratio of between 5:1 and 2:1. Additional interior sound damping techniques should also be employed. The triangular shape of the cabinet 12 assists in the eradication of much acoustic interference. The rearward sound waves are directed toward the distal point of the enclosure where they are dissipated as heat energy and are not reflected forwardly into the desired sound field.

The interior surfaces of the loudspeaker cabinet 12 are preferably covered with acoustic damping foam sheets 26. The foam sheets 26 help absorb sound waves that would otherwise interfere with the pure sound produced by the transducers 14. The foam sheets 26 may be of any commonly used material, but is preferably of the same composition and density as that used for exterior damping, for efficiency and economy of construction. Ideally, the interior foam sheets 26 will be made of polyurethane foam having a density of two to three pound per cubic foot and will have a thickness of onehalf to one inch.

FIG. 2 also shows fibrous material in the interior of the cabinet 12. Like the interior foam panels, the fibrous material also helps absorb interfering sound that is within the cabinet 12. The fibrous material may be wool, synthetic material, or any other acoustic batting material. The fibrous material is generally located in the rear of the cabinet 12. The rearward sound waves are directed toward the rear of the cabinet 12 by the angular side walls 18 and 18', and the fibrous material, by its positioning in the rear of the cabinet 12, helps absorb this sound.

It should be noted that any type of loudspeaker cabinet 12 material can be utilized without compromising the principles outlined above. The loudspeaker 10 is, however, designed to be built in an economical manner. The loudspeaker cabinet 12 may be sealed as shown in FIG. 2 or vented in the traditional manner as shown in FIG. 3. The function of the design is not necessarily limited to an environment of a high-fidelity audio system. A possible situation for use of the principles of the present invention would be in the design of integrated television loudspeakers.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

I claim:

1. A loudspeaker enclosure, comprising:

a baffle having a width and first and second side edges and being adapted to support at least one loudspeaker;

a plurality of walls, including first and second side walls, each having an interior surface and an exterior surface, said plurality of walls defining, with said baffle, an enclosure;

said first and second side walls each having a forward edge and a rearward edge;

said first and second side wall forward edges being connected to said first and second side edges of said baffle, respectively;

a first foam block covering said exterior surface of said first side wall and extending forwardly beyond said forward edge of said first side walls;

a second foam block covering said exterior surface of said second side wall and extending forwardly beyond said forward edge of said second side walls; and foam sheets mounted on and covering each said interior surface of each of said plurality of walls, wherein said foam sheets comprise polyurethane having a thickness of between one-half inch and one inch and having a density of between two pounds per cubic foot and three pounds per cubic foot.

2. A loudspeaker enclosure, comprising:

a baffle having a width and First and second side edges and being adapted to support at least one loudspeaker;

a plurality of walls, including first and second side walls, each having an interior surface and an exterior surface, said plurality of walls defining, with said baffle, an enclosure;

said first and second side walls each having a forward edge and a rearward edge; said first and second side wall forward edges being connected to said first and second side edges of said baffle, respectively, and said first and second side wall rearward edges being connected to each other;

said first and second side edges of said baffle defining an enclosure width; said first and second side wall rearward edges forming a point, and said point and said baffle defining a depth; said depth being one and one-half to three times greater than said width; and foam sheets mounted on and covering each said interior surface of each of said plurality of walls, wherein said foam sheets comprise polyurethane having a thickness of between one-half inch and one inch and having a density of between two pounds per cubic foot and three pounds per cubic foot.

* * * * *